US006279445B1

(12) United States Patent
Rosene et al.

(10) Patent No.: US 6,279,445 B1
(45) Date of Patent: Aug. 28, 2001

(54) MULTI-TOOL ALIGNMENT APPARATUS

(75) Inventors: Ronald G. Rosene, Coon Rapids; Richard L. Timp, Vadnais Heights; Glen M. Shuldes, New Brighton, all of MN (US)

(73) Assignee: Wilson Tool International, Inc., White Bear Lake, MN (US)

( * ) Notice: Subject to any disclaimer, the term of this patent is extended or adjusted under 35 U.S.C. 154(b) by 0 days.

(21) Appl. No.: 09/431,962

(22) Filed: Nov. 1, 1999

(51) Int. Cl.[7] ..... B26D 1/00; B26D 5/08

(52) U.S. Cl. ..... 83/698.91; 72/474; 72/446; 74/813 R; 83/50; 83/552; 83/571; 400/134; 408/35

(58) Field of Search ..... 72/414, 442, 446; 74/813 R, 813 L; 83/50, 552, 571, 698.13, 698.91; 400/129, 131, 134

(56) References Cited

U.S. PATENT DOCUMENTS

| | | | |
|---|---|---|---|
| 1,926,985 | 9/1933 | Podrabsky | 83/552 |
| 1,940,883 | 1/1933 | Rollings | 83/552 |
| 2,738,864 | 6/1956 | Ewaldson et al. | 192/70.14 |
| 3,921,486 | 11/1975 | Valente | 83/420 |
| 4,050,337 | 9/1977 | Allemand | 83/552 |
| 4,165,669 | 8/1979 | Brown et al. | 83/552 |
| 4,250,784 | 2/1981 | Bredow | 83/518 |
| 4,285,259 | 8/1981 | Jelinek et al. | 83/552 |
| 4,840,054 | 6/1989 | Sjogren | 72/382 |
| 4,934,169 | 6/1990 | Sjogren | 72/385 |
| 4,989,440 | 2/1991 | Sjogren | 72/385 |
| 5,012,712 * | 5/1991 | Nordquist | 83/698.91 X |
| 5,048,385 | 9/1991 | Eckert et al. | 83/34 |
| 5,072,620 | 12/1991 | Hill et al. | 72/414 |
| 5,201,589 | 4/1993 | Chun et al. | 400/134 |
| 5,211,095 | 5/1993 | Chun et al. | 83/552 |
| 5,382,102 | 1/1995 | Brolund et al. | 400/134 |

* cited by examiner

*Primary Examiner*—W. Donald Bray
(74) *Attorney, Agent, or Firm*—Fredrikson & Byron, P

(57) ABSTRACT

A self-aligning multi-tool for use in a punch press having a ram. The multi-tool includes a housing carrying a striker and a magazine bearing a plurality of circumferentially spaced tools and rotatable with respect to the housing so as to bring a single desired tool into alignment with the striker. The housing has a striking surface adapted to be engaged by the ram of a punch press and configured to rotationally lock to the ram when correctly rotationally aligned therewith to prevent the housing from rotating as the magazine is rotated. The housing is provided with at least one alignment pin having a tapered cam surface and positioned such that the ram will contact and cam against the tapered cam surface of the pin as the ram approaches the striking surface if the machine ram and the striking surface are rotationally misaligned so as to urge the housing to rotate into correct alignment with the ram to enable rotational locking therebetween.

12 Claims, 4 Drawing Sheets

MULTI-TOOL ALIGNMENT APPARATUS

FIELD OF THE INVENTION

This invention relates to an alignment apparatus for a multi-tool of the type employed in punch presses.

BACKGROUND OF THE INVENTION

Punch presses commonly have an actuating ram, an upper platform which holds a punching tool, and a lower platform that supports a die in vertical alignment with the punching tool. Turret-type punch presses utilize a rotatable upper platform that has a series of tool mounting stations arranged around its periphery for receiving different punching or marking tools. Rotation of the platform brings a selected punch into position above a work station and beneath the ram. A lower platform is provided with a corresponding series of dies, and is rotatable with the upper platform to enable the proper die to be aligned with a selected punch.

Certain punch tools themselves can be "multi-tools." That is, a punching tool, instead of containing only a single punch, may contain a magazine bearing a series of vertically movable punches in circumferentially spaced bores. The magazine itself can be rotated, as by a worm gear or the like, about a central vertical axis so as to place the correct punch above a work piece in a work station. Multi-tool mechanisms of this type are used, for example, for punching selected numbers or letters into a work piece, as well as for punching holes through the thickness of a work piece. A lower magazine containing a plurality of corresponding dies also may be provided so that as the magazine containing the punches is rotated about its axis, the lower magazine is rotated as well to bring the appropriate die into vertical alignment with the selected punch.

Carried above a multi-tool magazine is a multi-tool carrying a striker. As the multi-tool is struck downwardly by the ram of a punch press, the striker is forced downwardly into contact with a vertically aligned punch, causing that punch in turn to strike the work piece. The width of the striker at its bottom end is generally less than the distance between adjacent punches in the magazine, so that the striker cannot strike more than one punch at a time.

The multi-tool commonly is prevented by its contact with the punch press ram from rotating as the magazine is rotated about its axis to bring a selected tool into vertical alignment with the striker. In a typical procedure, the punch press ram descends into a rotationally locking engagement with the multi-tool, following which the magazine is rotated to bring a selected punch into alignment with the striker, and then the multi-tool is depressed further by the ram to cause the striker to engage the aligned punch in a punching operation.

The striker housing and tool ram have faces configured so that when they are brought together, the striker housing is rotationally locked to the punch press ram. The punch press ram, for example, may have a flat, generally rectangular shaped bottom surface that is received into a complementary slot or other configuration of the striker housing so that the striker housing is held rotationally stationary by the punch press ram.

A problem arises with certain punch presses in that the precise angular position of the punch press ram cannot be assured each time the striker housing is positioned over a tool ram. Rotational misalignment between the punch press ram and the striker housing may only be on the order of a few degrees, but may yet be sufficient to prevent the striker housing and the punch press ram from rotationally locking together. Rotational misalignment of the ram with the striker housing may prevent the punch press ram, as it descends into contact with the striker housing, from rotationally locking to the striker housing. The striker housing itself hence may undergo some rotation as the magazine is rotated, with the result that the striker is not aligned with the correct punching tool. The work piece accordingly may be ruined, and substantial damage may result to the striker housing.

It would be desirable to correct any misalignment of the striker housing and the punch press ram so as to enable them to rotationally lock together and prevent rotation of the striker housing as the tool magazine is rotated beneath it.

SUMMARY OF THE INVENTION

The present invention provides a self-aligning multi-tool for use in a punch press. The multi-tool includes a striker housing carrying a striker, and a magazine bearing a plurality of circumferentially spaced tools, the magazine being rotatable with respect to the striker housing so as to bring a desired tool into alignment with the striker to enable it to be struck by the striker.

The housing has a striking surface adapted to be engaged by the ram of a punch press and configured to rotationally lock to the ram when correctly rotationally aligned therewith to prevent the striker housing from rotating as the magazine is rotated. The housing includes at least one alignment pin having a tapered cam surface and positioned such that the punch press ram will contact and cam against the tapered cam surface of the pin as the ram approaches the striking surface if the striker housing and striking surface are rotationally misaligned, thus urging the striker housing to rotate into correct alignment with the ram to enable rotational locking therebetween.

In a preferred embodiment, a pair of alignment pins are received in recesses in the upper surface of the striker housing and are positioned to receive between them the ram to rotationally lock the ram to the housing. Springs are provided to urge the alignment pins upwardly, the recesses being configured to enable the pins to be substantially completely received in the recesses when the ram and striker housing are severely mis-aligned. The springs, which may be helical springs received in the recesses, are sufficiently stiff so that downward pressure of the ram against the camming surface of an alignment pin causes the striker housing to rotate, rather than to depress the pin into its recess, but preferably are sufficiently yielding as to enable a pin to be depressed within its recess if the housing is forcibly rotated by the magazine with respect to the ram to restrain damage to the ram or multi-tool.

DETAILED DESCRIPTION OF THE PREFERRED EMBODIMENT

Figure 1:
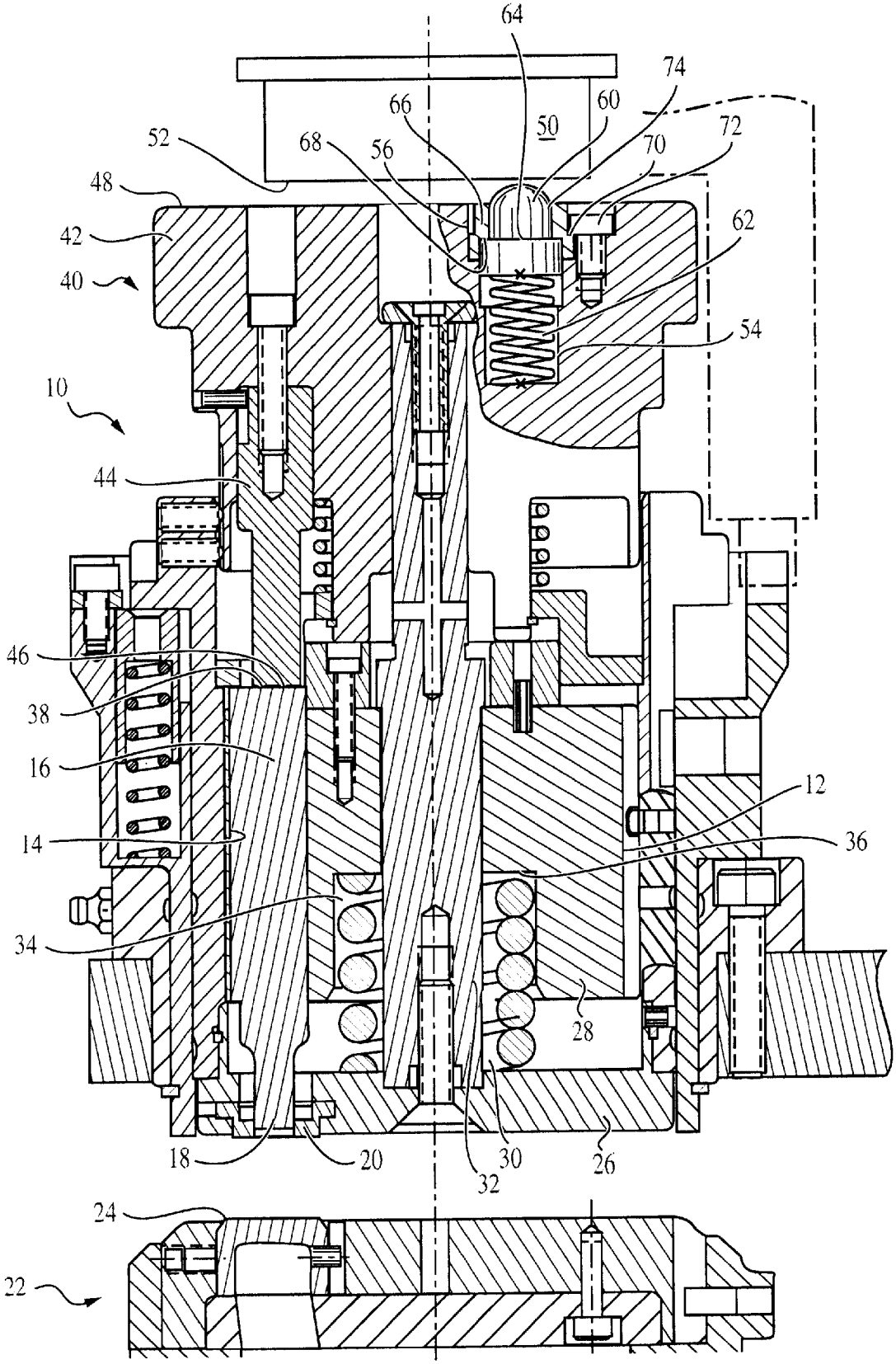
FIG. 1 is a partially broken away view, and partial cross-section, showing a multi-tool of the invention.

Exemplified in FIG. 1 is a multi-tool of the invention, designated generally 10. The multi-tool includes a tool magazine 12 having a generally cylindrically shape. The magazine includes a plurality of vertical bores 14 about its periphery carrying, respectively, a plurality of punches 16, of which one is shown at 16. The bottom tip 18 of the punch may have a cutting edge, as for forming holes in a workpiece, or may have one or more raised alphanumeric characters or some other symbol that is to be stamped into the workpiece. A stripper plate, shown at 20, is provided to enable the punch tip to be withdrawn from a work piece in the event that a cut is made through the thickness of the work piece. For completeness, a die is shown at 22, the die having a die surface 24 capable of receiving the punch tip 18. In the embodiment depicted, the punch tip 18 is an alphanumeric character, and the die surface 24 provides an upwardly facing flat surface to support the work piece immediately beneath the punch.

The magazine includes a bottom plate 26 which carries the stripper plate 20 and which is mounted to the body 28 through the use of a spring 30 carried about a post 32, the spring extending upwardly into a recess 34 about the post 32 and being captured between the upper surface 36 of the recess and the upper surface of the bottom plate 26.

A striker housing designated generally as 40 includes an housing body 42 that is rotationally mounted to the magazine 12 so that when the housing body 42 is held stationary, the magazine may be rotated about its axis A with respect to the housing. Carried vertically in a bore formed in the housing is a striker 44, the striker having a lower end 46 that is vertically aligned with the punch 16. When the striker housing 42 of the multi-tool is held stationary, rotation of the magazine 12 brings punching tools 16 sequentially into alignment beneath the striker 44. The width of the tip 46 of the striker, measured circumferentially (that is, perpendicular to the plane of the paper in FIG. 1) is less than the distance between the upper ends 48 of neighboring punches so that under no circumstances can the striker engage more than one punch at a time. On the other hand, the upper surface 38 of the punch is sufficient broad so that it can be struck by the striker head 46 even though the striker and punch may be slightly rotationally mis-aligned, as will be explained in greater detail below.

Also shown in FIG. 1 is the lower portion of a punch press ram 50. The ram is typified in the drawing as having a lower surface 52 that is generally rectangular in cross section, the long dimension of the ram being shown in FIG. 1 and the shorter dimension of the ram being shown in, for example, FIGS. 6–9. The ram is driven mechanically, or, more commonly, hydraulically. The hydraulic or mechanical operation of punch presses is well known, and needs no further explanation.

The rotational orientation of a punch press ram is usually controlled with some precision, but occasionally the striking surface of the ram will vary from its intended rotational position so that it does not properly align rotationally with the upper striking surface 48 of the striker housing. Inasmuch as close rotational alignment between the bottom of the ram and the top of the striking housing is required in order to lock the ram and housing rotationally together, slight rotational misalignment of the ram and striker housing may enable the striker housing to rotate with the magazine as the magazine is rotated, and it is to this problem that we now turn. It will be understood that the confronting, interlocking portions of the ram and the striker housing may have a variety of different configurations enabling them to lock together, and the particular configuration described below, in which the bottom, striking surface of the ram is generally rectangular in cross section, should be considered illustrative and not limiting. Typical ram face configurations include rectangular, key-hole, obround and double D shapes, the latter being essentially race track shaped.

Figure 2:
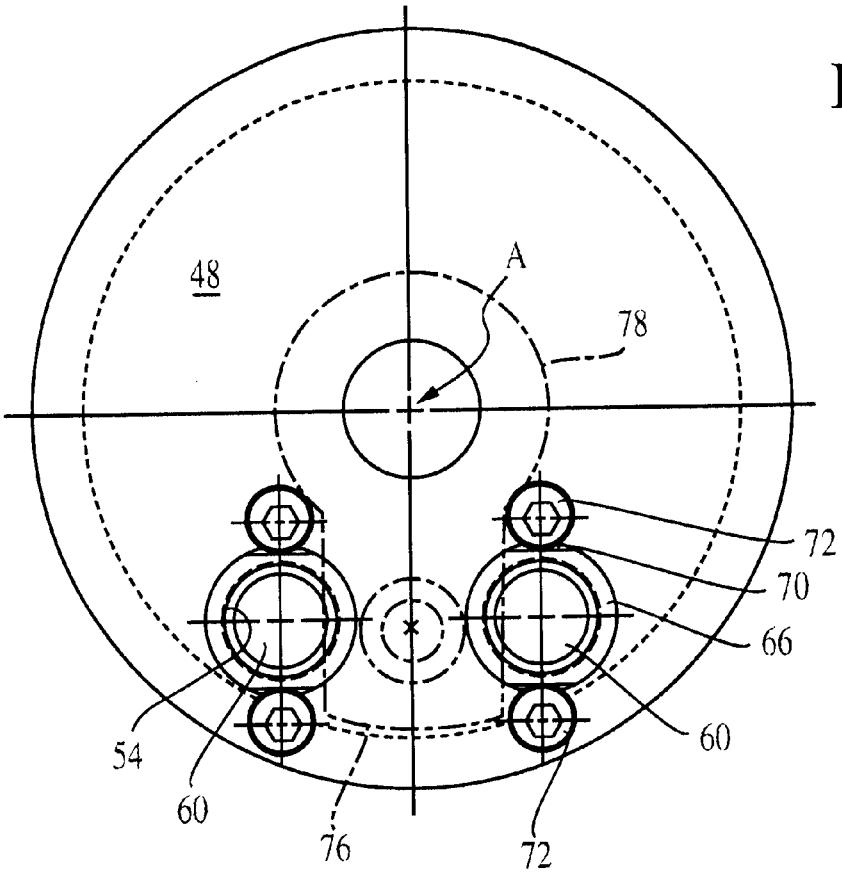
FIG. 2 is a top view of the tool of FIG. 1.

With reference to FIGS. 1 and 2, a pair of spaced recesses 54 are formed in the upper surface of the striker housing, the recesses preferably being bores that are upwardly open and that receive within them alignment pins 60, the upper ends of the alignment pins protruding above the surface 48 of the striker housing. A spring, typified as a helical spring 62, is positioned within each bore 54, the bottom of the spring pressing against the bottom of the bore and the upper end of the spring pressing upwardly against the bottom surface of the alignment pin 60 so as to urge the pin upwardly.

As shown in FIG. 1, each alignment pin 60 has an annular, upwardly facing shoulder 64. The bore 54 itself may have an enlarged upper portion 56 within which is received a bushing 66, the bushing having an annular, downwardly facing shoulder 68 that encounters the shoulder 64 so as to limit the upward movement afforded the pin 60. The bushing 66 itself may have upwardly facing, opposed flat surfaces 70 ground into its external surface, as shown in FIG. 1, and hold down screws 72 may be employed to contact the surfaces 70 of the bushing to retain the bushing in the bore 54. The alignment pin 60 includes a tapered or rounded camming surface 74 at an angle to the vertical.

Shown in phantom lines in FIG. 2 is the "foot print" of the ram 50 upon the upper surface of the striker housing, showing the proper orientation of the ram with respect to the alignment pins. It will be noted here that in this illustrative embodiment, the ram has a substantially rectangular portion 76 extending between the pin 60, and also a slightly enlarged cylindrical portion 78 that is coaxial with the axis A of the striker housing and of the magazine.

Figure 7:
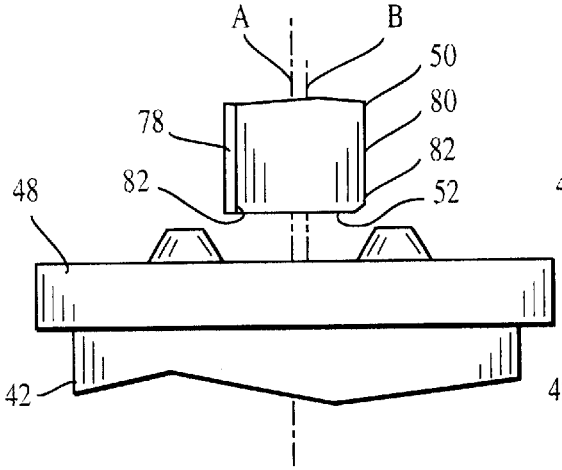
FIG. 7 is a view similar to that of FIG. 6 but showing misalignment of parts.

As shown best in FIG. 7, the side walls 80 of the ram meet the bottom striking surface 52 at slightly rounded edges 82 to afford smooth sliding contact between the edges 82 of the ram and the slanted or tapered camming surfaces 74 of the alignment pins.

Different alignment pin configurations are shown in FIGS. 1, 3, 4 and 5. In FIG. 1, the alignment pin has a generally hemispherical shape, and will be understood that as the edge 82 of the descending ram 50 encounters an off-center portion of the hemispherical surface of an alignment pin, that alignment pin (and the body of the striker housing) will be cammed to one side. Referring to FIG. 2, it should now be evident that such camming force actually urges the striker housing to rotate in one direction or the other around the axis A, depending upon the misalignment of the ram with the striker housing.

Figure 3:
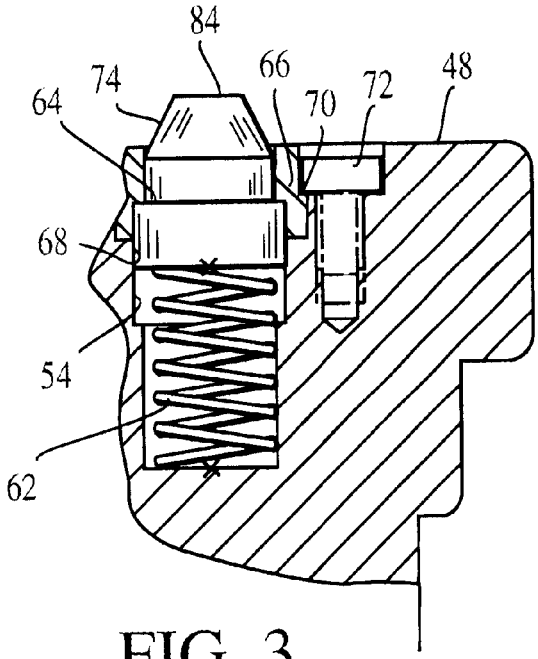
FIG. 3 is a broken away, cross-sectional view of a portion of the multi-tool device of FIG. 1, showing a modified embodiment thereof.
Figure 4:
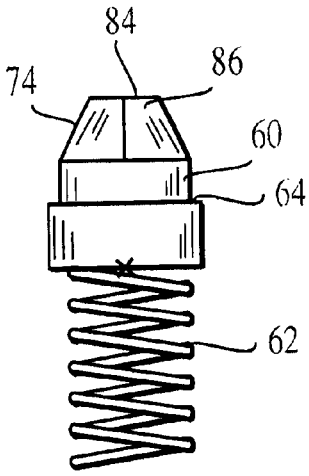
FIG. 4 is a broken away view of a portion of the device of FIG. 3, showing another embodiment thereof.
Figure 5:
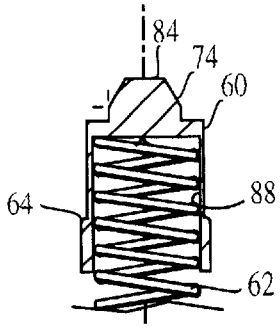
FIG. 5 is a view similar to that of FIG. 4, but showing yet another embodiment thereof.

The alignment pin 60 shown in FIG. 3 has a frustoconical camming surface 74, the surface terminating upwardly in a generally flat top section 84. In FIG. 4, the camming surface 74 is pyramidal, the camming surface actually consisting of three or four or more upwardly convergent separate faces 86. In FIG. 5, the alignment pin 60 has an internal bore 88 which receives the spring 62, the camming surface 74 also being frustoconical. Various other configurations for the alignment pins will be evident to those skilled in the art.

Figure 6:
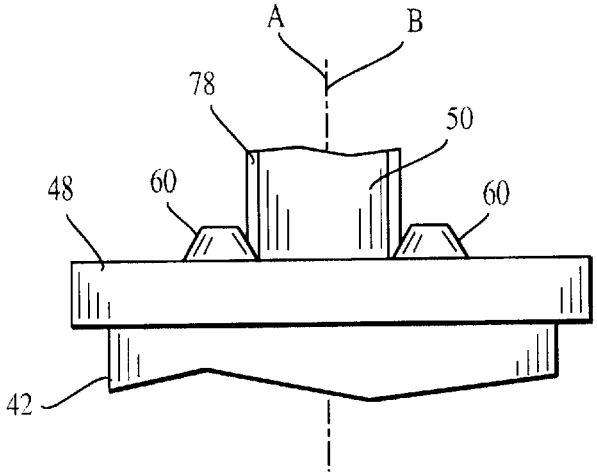
FIG. 6 is a broken away schematic view of a portion of the multi-tool of the invention, showing a particular positioning of parts thereof.

Operation of the multi-tool device of the invention is illustrated schematically in FIGS. 6–9. In FIG. 6, the ram and the upper surface 48 of the striker housing are correctly rotationally aligned, and it will be noted that the ram is centered precisely between the alignment pins 60.

Figure 8:
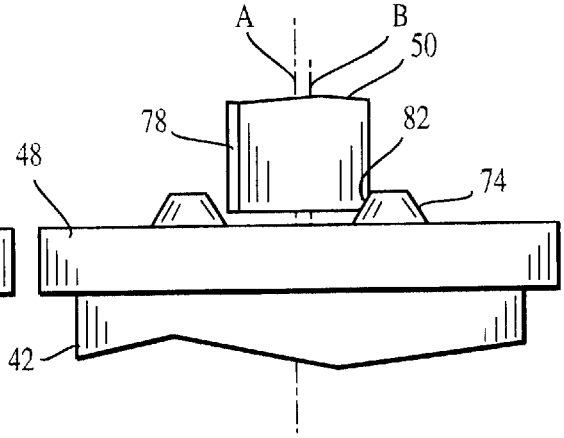
FIG. 8 is another view similar to that of FIG. 6, and illustrating realignment of misaligned parts.

In FIG. 7, the ram 50 is shown rotationally misaligned with respect to the striker housing. The ram is displaced slightly to the right so that as the ram descends, its edges will not be precisely centered between the alignment pin 60 as in FIG. 6. Rather, the edge 82 of the ram will encounter the camming surface 74 of the nearest alignment pin, as shown in FIG. 8, causing that alignment pin to be cammed to the right in FIG. 8, resulting in a counterclockwise (from above) rotation of the striker housing 42. Once the striker housing has been rotated so that the alignment shown in FIG. 6 has been obtained, the ram is rotationally locked to the upper surface 48 of the striker housing so that as the magazine is rotated, the striker housing will remain rotationally stationary.

Figure 9:
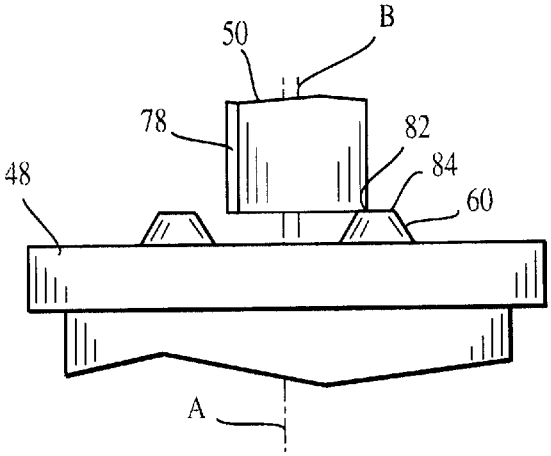
FIG. 9 is a view similar to that of FIG. 6 but showing a different positioning of parts.

In extreme circumstances, the punch press ram 50 may become so misaligned with the striker housing that correction of the alignment may no longer be feasible. This situation is illustrated in FIG. 9. Here, an edge 82 of a descending ram has encountered instead the generally flat upper surface 84 of an alignment pin. To avoid substantial damage to the tool, the alignment pin 60 is simply depressed as the ram descends, the pin being received within its recess in the striker housing.

As mentioned above in connection with FIG. 1, the bottom face 46 of the striker does not have to be precisely centered on the upper surface 38 of the punch. Although the width of the striker at its bottom is such that it cannot contact two punches at one time, the striker may be offset slightly from the punch and still accomplish an acceptable punching operation. Hence, a slight rotational misalignment of the striker housing with respect to the punch magazine, due to the realignment of the ram and striker housing as described above, may be permitted without damage to the punch or work piece. Rotational movement of the striker housing with respect to the ram of up to about 5° in either direction may be permitted.

Preferably, the camming surface 74 of the alignment pins shown in FIGS. 3–9 is at about 30° to the vertical to enable the pins to readily be cammed to one side or the other, although this angle can be varied as desired. An angle of 45° to the vertical may provide good results. The hemispherical pin shape shown in FIG. 1 provides a curved camming surface in which the angle of the surface with respect to the vertical varies in accordance with the distance from the center of the hemispherical surface. It will be understood that a certain amount of camming force—a force acting horizontally on the pins—will be required in order to cause rotation of the striker housing as the ram descends. The spring 62 is chosen so that it is sufficiently stiff as to hold the pins upright in the position shown in FIGS. 7 and 8 as camming occurs, but yet is sufficiently yielding to enable the pin to be depressed fully within its recess in the event that the top surface 84 of the pin is encountered by the ram, as shown in FIG. 9.

Figure 10:
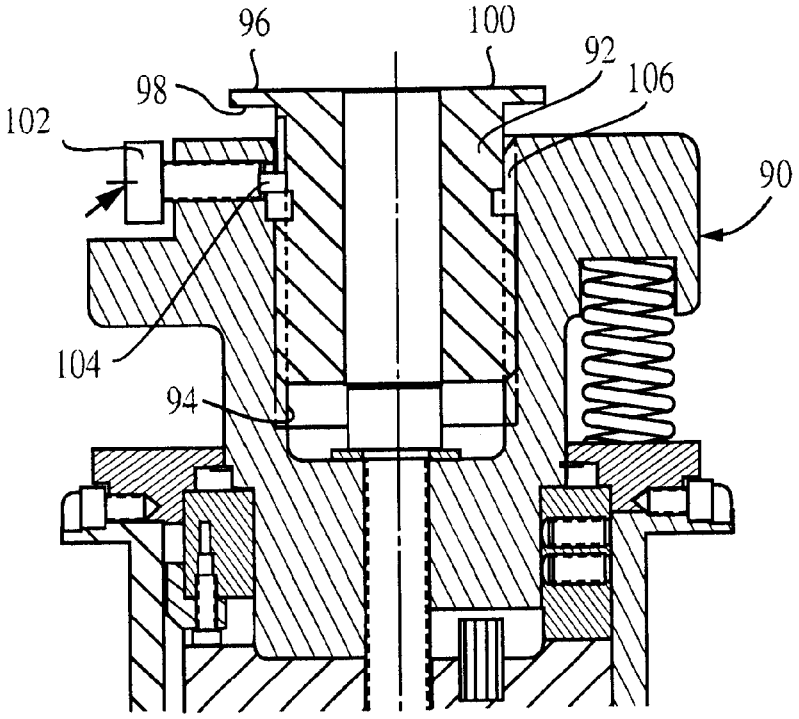
FIG. 10 is a broken-away view, in partial cross-section, of a modified multi-tool embodiment, with alignment pins removed.
Figure 11:
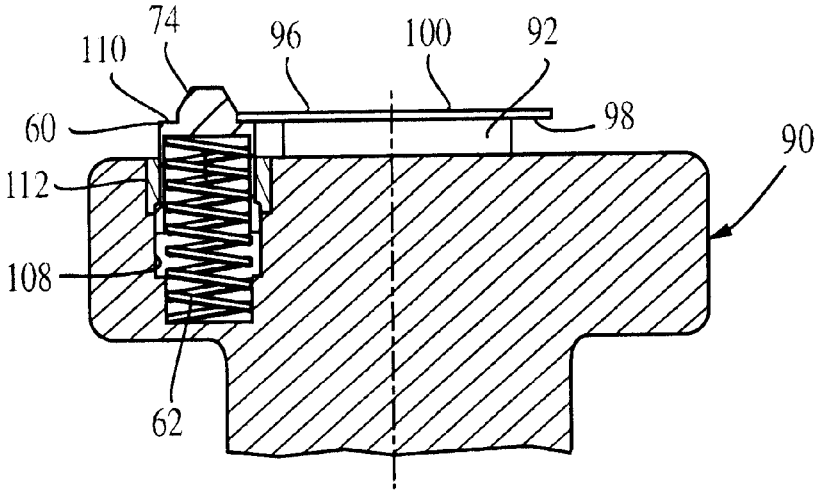
FIG. 11 is a cross sectional, broken-away view of the multi-tool of FIG. 10 showing the position of an alignment pin.

Referring now to the embodiment depicted in FIGS. 10 and 11, a striker housing is designated generally as 90, and includes an externally threaded adjustment plug 92 that is threaded into a central, internally threaded bore 94 formed in the housing 90. At its upper end, the plug 92 has a generally circular cap 96 of increased diameter, the cap providing a downwardly facing annular shoulder 98 and having an upper striking surface 100 to be struck by a ram. The length of the multi-tool can thus be changed by screwing the plug into or out of the bore 94. A spring-loaded plunger 102 extends through a side wall of the housing 90 and has an inner end 104 that protrudes into contact with any one of a plurality of circumferentially spaced teeth 106 formed on the circumferential surface of the plug 92, for the purpose of rotationally locking the plug to the housing when the multi-tool has been adjusted to a desired length.

Alignment pins 60 of the type shown in FIG. 5 may be received in recesses 108 formed in the striker housing, as shown in FIG. 11. The pins, which are centered radially beyond the periphery of the cap, each have upwardly facing annular shoulders 110 which are urged upwardly into contact with the annular shoulder 98 of the cap by springs 62. The alignment pins are prevented from escaping from the recesses by press-fitted bushings 112, as described above, but in the working length of the multi-tool, the upward movement of the pins is restrained only by cap shoulder 98. In this manner, as the adjustment plug is rotated with respect to the striker housing to change the distance that the cap 96 protrudes from the housing recess 94, the alignment pins simultaneously move inwardly or outwardly of their recesses but always maintain the same height with respect to the cap, as shown in FIG. 11. As with the earlier described embodiments, the camming surface 74 of the alignment pins extends downwardly at least approximately to the level of the striking surface 100 of the cap.

In the event that the striker housing and the magazine become unintentionally rotationally fixed to each other, as might happen, for example, if debris accumulates between them or a punch becomes stuck in its up position, then the striker housing will be forced to rotate with the magazine as the latter is rotated. The ram 50, however, even though initially properly positioned between the alignment pins as in FIG. 6, remains rotationally stationary. In this situation, the camming surface 74 of one of the pins will encounter the ram edge as the striker housing is rotated, and the spring 62 accordingly must be sufficiently yielding so that horizontal rotation of the pin against the ram causes the pin to be cammed downwardly into its recess to avoid damage to the ram or to the multi-tool. It will be noted that the camming surfaces 74 of the pins, even when in their uppermost position, extend downwardly to the surface 48 of the striker housing (the surface 100 of the adjustment plug 92, in FIGS. 10 and 11) that is encountered by the ram so that relative rotation of a pin against the ram will cause camming of the pin into its recess.

While several forms of the invention have been shown and described, other forms will be apparent to those skilled in the art. The embodiment shown on the drawings and described above are merely for illustrative purposes and are not intended to limit the scope of the invention, which is defined by the claims which follow:

What is claimed is:

1. A self-aligning multi-tool for use in a punch press having a ram, comprising a housing carrying a striker, a magazine bearing a plurality of circumferentially spaced tools and rotatable with respect to the housing so as to bring a single desired tool into alignment with the striker, said housing having a striking surface adapted to be engaged by the ram of a punch press and said housing rotationally locking to the ram when correctly rotationally aligned therewith to prevent the housing from rotating as the magazine is rotated; said housing including at least one alignment pin having a tapered cam surface and positioned such that the ram will contact and cam against the tapered cam surface of the pin as the ram approaches the striking surface if the machine ram and the striking surface are rotationally mis-aligned so as to urge the housing to rotate into correct alignment with the ram to enable rotational locking therebetween.

2. The multi-tool of claim 1 including a pair of said alignment pins carried adjacent the periphery of the housing and spaced so as to receive closely between them the ram to rotationally lock the housing to the ram.

3. The multi-tool of claim 2 wherein said pins have frustoconical camming surfaces.

4. The multi-tool of claim 2 wherein said pins have pyramidal camming surfaces.

5. The multi-tool of claim 2 wherein said pins have generally spheroidal camming surfaces.

6. The multi-tool of claim 2 wherein said housing includes recesses sized to substantially fully receive said alignment pins, and springs urging said alignment pins outwardly of said recesses.

7. The multi-tool of claim 6 including an adjustment plug threadably received in said striker housing and having a cap defining said striking surface, the cap and alignment pins having engaging portions restraining upward movement of the pins and maintaining vertical alignment of the pins with the cap striking surface.

8. The multi-tool of claim 2 in combination with a punch press having a ram movable along an axis toward and away from said striking surface of said multi-tool, the ram having a ram surface facing the striking surface of the striker housing and configured to rotationally lock to the housing between said pins when correctly rotationally aligned with the housing to prevent the housing from rotating as the magazine is rotated.

9. The combination of claim 8 wherein said ram surface includes an edge configured to contact and cam against the tapered cam surface of a pin as the ram approaches the striking surface if the ram and the striking surface are rotationally mis-aligned.

10. The combination of claim 8 wherein said tapered cam surfaces are frustoconical.

11. The combination of claim 10 wherein said housing includes recesses sized to substantially fully receive said alignment pins, and springs urging each alignment pin outwardly of its recess.

12. In combination, a punch press having a ram, and a self-aligning multi-tool comprising a housing carrying a striker, a magazine bearing a plurality of circumferentially spaced tools and rotatable with respect to the housing so as to bring a desired tool into alignment with the striker, said housing having a striking surface positioned to be engaged by said ram; said housing including at least a pair of circumferentially spaced alignment pins having tapered cam surfaces and oriented to receive between them said ram to rotationally lock the ram to the housing when the ram and housing are correctly rotationally aligned but to enable the ram to contact and cam against the tapered cam surface of a pin as the ram approaches the striking surface if the machine ram and the striking surface are rotationally mis-aligned so as to urge the housing to rotate into correct alignment with the ram to enable rotational locking therebetween.

* * * * *

UNITED STATES PATENT AND TRADEMARK OFFICE

CERTIFICATE OF CORRECTION

PATENT NO. : 6,279,445 B1
DATED : August 28, 2001
INVENTOR(S) : Rosene et al.

It is certified that error appears in the above-identified patent and that said Letters Patent is hereby corrected as shown below:

Title page,
Item [75], after "Glen M. Shuldes" and before "New Brighton" please delete "," and insert the following:

-- ; Gordon Straka, --.

Signed and Sealed this

Thirteenth Day of May, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,279,445 B1
DATED : August 28, 2001
INVENTOR(S) : Rosene et al.

It is certified that error appears in the above-identified patent and that said Letters Patent is hereby corrected as shown below:

Title page,
Item [75], Inventors, replace inventor list with the following:
-- Ronald G. Rosene, Coon Rapids;
Richard L. Timp, Vadnais Heights;
Glen M. Shuldes, New Brighton;
Gordon Straka, Afton, all of MN (US) --

Signed and Sealed this

Eleventh Day of November, 2003

JAMES E. ROGAN
*Director of the United States Patent and Trademark Office*